United States Patent [19]

Messing

[11] 4,194,458

[45] Mar. 25, 1980

[54] WINDSURFER WITH AUXILIARY PROPULSION EQUIPMENT

[75] Inventor: Manfred Messing, Reutlingen, Fed. Rep. of Germany

[73] Assignee: Lotte Kronwitter, nee Staiber, Guenznerg, Fed. Rep. of Germany

[21] Appl. No.: 850,854

[22] Filed: Nov. 11, 1977

[30] Foreign Application Priority Data

Nov. 16, 1976 [DE] Fed. Rep. of Germany ..... 2652129

[51] Int. Cl.[2] ..... B63H 9/04

[52] U.S. Cl. ..... 114/39; 9/7; 9/310 E; 49/37; 114/90; 115/24.1; 115/70; 297/331

[58] Field of Search ..... 114/39, 90; 9/310 E, 9/310 B, 7; 115/24.1, 18 E, 70; 296/69; 297/15, 331; 49/37; 211/60 R

[56] References Cited

U.S. PATENT DOCUMENTS

| | | | |
|---|---|---|---|
| 1,701,684 | 2/1929 | Lee | 9/7 X |
| 2,685,696 | 8/1954 | Oscanyan | 9/310 B |
| 3,599,168 | 8/1971 | Long | 115/18 E X |
| 3,956,785 | 5/1976 | Halfon | 114/39 X |
| 4,050,178 | 9/1977 | Bryan | 211/60 R X |

FOREIGN PATENT DOCUMENTS

| | | | |
|---|---|---|---|
| 2363255 | 6/1975 | Fed. Rep. of Germany | 9/310 E |
| 1312320 | 4/1973 | United Kingdom | 115/24.1 |

*Primary Examiner*—Sherman D. Basinger
*Attorney, Agent, or Firm*—Michael J. Striker

[57] ABSTRACT

A standard windsurfer having a surfboard-type body provided with a daggerboard and having a mast and boom that support a sail on the surfboard is formed with an upwardly open storage compartment that is normally covered by a reversible lid. One side of the lid is smooth and when turned up forms a smooth continuation of the upper surface of the surfboard. The other side is formed with a seat which when turned up provides a stable sitting place for the user of the windsurfer who may also place his or her feet in recesses in front of this seat. The mast and boom may be held on the top of the surfboard by means of clips, with the mast passing through a groove formed in the seat. The storage compartment contains auxiliary propulsion equipment such as a paddle which may fit into the end of a mast section, or a small electric outboard motor.

10 Claims, 4 Drawing Figures

WINDSURFER WITH AUXILIARY PROPULSION EQUIPMENT

BACKGROUND OF THE INVENTION

The present invention relates to a windsurfer.

A windsurfer, such as described in U.S. Pat. No. 3,487,800 of Schweitzer, has a surfboard body adapted to float in the water and having a generally flat upper surface. The lower surface of the body is provided with a fixed or removable daggerboard and the upper surface is provided adjacent the front end with a socket for a universal joint carried on the base of a mast. A sail carried on this mast is held within a double-bow boom, with the universal joint constituting the only connection between the mast and the board. A user of such a device stands on the upper surface to the weather side of the sail and holds the respective bow of the boom in his or her two hands, while leaning into the wind. With such a device it is therefore possible to combine the sports of surfing and sailing.

A disadvantage of these known structures is that it is often necessary to move well off the water's edge in order to find winds strong enough to permit sailing. Furthermore it is also frequently necessary when becalmed to painstakingly paddle the entire apparatus back to the water's edge. Such propelling of the known windsurfers through the water manually is a relatively uncomfortable operation, compounded by the fact that it is necessary to hold the mast, sail and boom while doing so. Furthermore the device occasionally is damaged or wind becomes so strong that it is impossible to use the wind to propel it, so that once again the user must uncomfortably paddle back to the shore or abandon his or her expensive sporting equipment.

SUMMARY OF THE INVENTION

It is therefore an object of the present invention to provide an improved windsurfer.

Another object is to provide such a surfer which overcomes the above-given disadvantages.

These objects are attained according to the present invention in a windsurfer of the above-described general type wherein a seat adapted to support a user in a sitting position on the board is provided to make displacement of the board through the water a comfortable task. Furthermore the board is provided with a storage compartment in which is contained means for propelling the board through the water such as a paddle or small electric outboard motor.

According to a feature of this invention the upper surface of the surfboard constituting the body of the windsurfer is formed in part by a removable lid having one smooth side that is normally turned up during wind surfing, and another side provided with the above-described seat. Thus this lid which normally covers the storage compartment can be turned over to provide a comfortable seat for the user, but when the windsurfer is being used for windsurfing the flat smooth side is up so that the seat does not project upwardly and interfere with proper windsurfing. In fact the smooth side of this lid or cover for the storage compartment constitutes a smooth continuation of the upper surface of the body of the windsurfer so that it presents absolutely no hindrance to windsurfing when turned up.

In addition according to this invention the upper surface of the body is formed in front, relative to a normal direction of travel of the body through the water, of the seat with recesses that are adapted to receive the heels of the feet of a person sitting on the seat. Thus it is possible for a person to sit on the windsurfer in a very comfortable and stable position. Furthermore when the means for propelling is constituted as a paddle it is possible for the person to row the boat strongly through the water without worrying about sliding off the normally smooth surface of the surfboard.

According to yet another feature of this invention two such paddles are provided and the paddles are adapted to fit in the opposite ends of the mast or a section of the mast so that it is possible to use the arrangement in a dual-paddle kayak-type system.

It also lies within the scope of this invention to provide the rear end of the surfboard, in a region normally out of the way of the seat of the user of the windsurfer, with a mount for a small outboard motor whose battery is permanently mounted inside the storage compartment. This relatively small motor can therefore be attached to the surfboard for displacement through considerable distances, albeit at low speed.

According to yet another feature of this invention the board is provided on its upper surface at both ends of the board with holders or clips for the mast so that the mast can be laid on the upper surface of the board and secured in a position extending parallel to the board. In accordance with another feature of this invention the seat which projects when used from the upper surface is formed with a longitudinally extending groove or recess in which the central portion of the mast is received so that this mast, when lying on the upper surface of the board, in no way makes the seat less comfortable or functional.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 2:
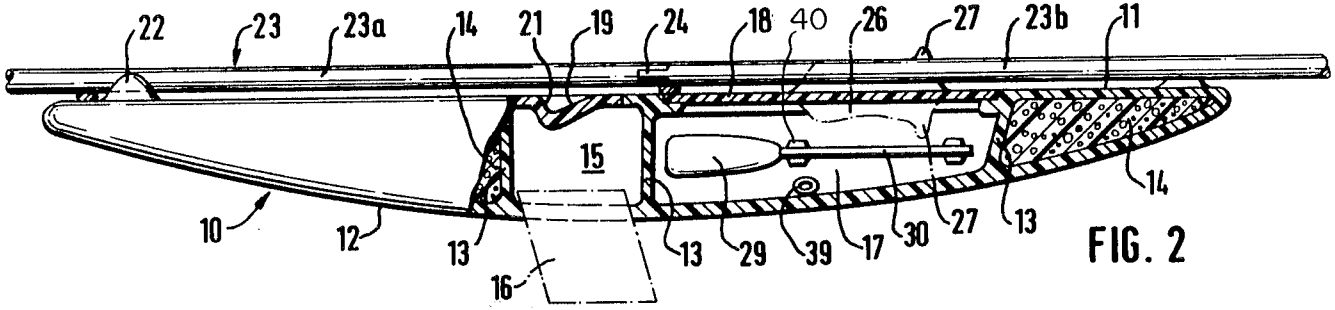
FIG. 2 is a section taken along line II—II of FIG. 1.
Figure 1:
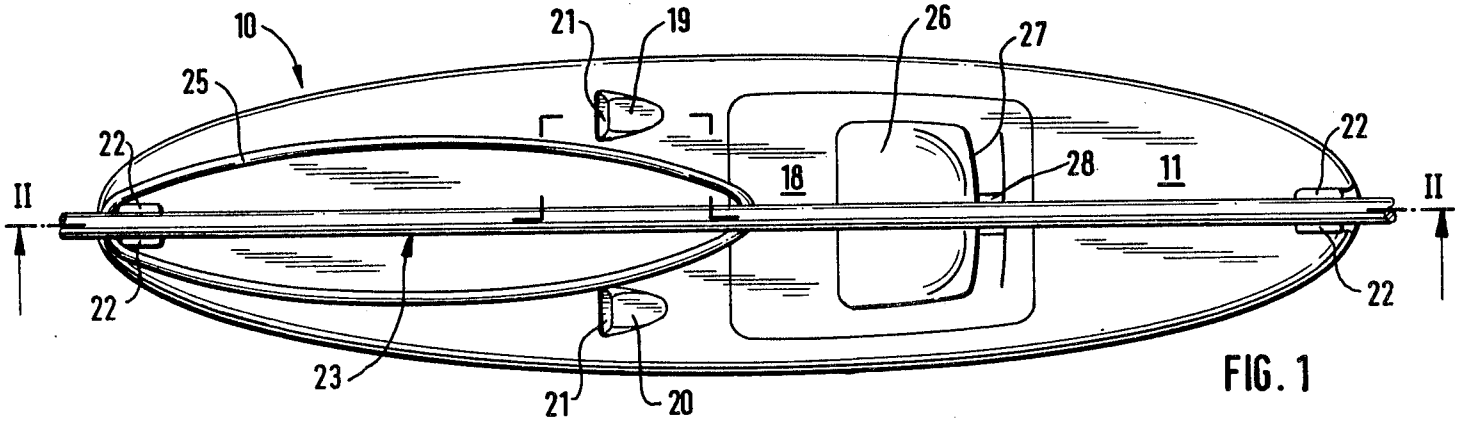
FIG. 1 is a top view of a windsurfer according to this invention.

As shown in FIGS. 1 and 2 a windsurfer according to this invention has a surfboard-type body 10 made of synthetic resin material and having a flat upper surface 11 and a curved and downwardly rounded lower surface 12. This body 10 is hollow and is provided with internal transverse partitions 13 that subdivide it into compartments some of which are filled with synthetic-resin foam 14 for flotation. In addition a slot 15 is formed for a removable dagger board 16.

The body 10 is used in conjunction with a mast 23 formed with a pair of halves 23*a* and 23*b* force-fitted together at a split part 24, and with a bow-type boom 25. In use the mast 23, to which is fixed a triangular sail, is stood in a universal joint fitted in the front region of the board 10 with the mast 23 vertical and the bow 25 approximately horizontal. This structure is described in the above-cited Schweitzer U.S. Pat. No. 3,487,800, whose entire disclosure is herewith incorporated by reference.

In addition according to the present invention the body 10 is formed with an upwardly open storage compartment 17 normally closed by a lid or cover 18. In front of this compartment 17 relative to the normal direction of travel of the body 10 through the water there are formed two transversely spaced recesses 19 and 20 having respective front surfaces 21 adapted to support the heels of a person sitting on a seat 26 formed on one side of the cover 18 and having a short backrest 27.

Thus the user of the surfboard can turn the cover 18 into the position shown in FIG. 2 with the seat 26 projecting upwardly. This user can then sit on this seat 26 with his or her back against the rest 27 and place his or her heels in the recesses 19 and 20 with the soles of the feet against the surfaces 21. This is an extremely comfortable and stable position.

In addition the body 10 is provided at each end with a clip or holder 22 and the seat 26 is formed with a longitudinally extending recess 28 in line with these holders 22. The mast 23 in assembled condition can thus be laid on top of the surfboard body 10 and held in the clips 22, while extending through the recess 28. In this position it is still possible for the user of this board to comfortably sit on the seat 26 over top of the groove 28 in which lies the mast 23.

Figure 4:
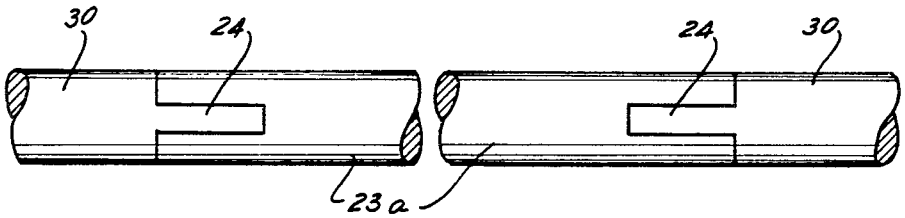
FIG. 4 is a view showing paddles connected with a mast section of the inventive windsurfer.

Inside the compartment 17 there is provided a pair of oars or paddles 29 having handles 30 held in clips 40 on the sidewalls of the compartment 17. Furthermore an eye 39 may be provided in this compartment 17 for securing objects therein, as well as for securing the cover 18 around the recessed rim of the compartment 17. To this end a piece of elastic shock cord may be secured to the cover 18 and to the eye 39 to elastically hold the cover 18 in place. The mast sections 23*a* and 23*b* are formed at their ends with recesses such as the split 24 which exactly receive the paddles 29. Thus, it is possible to fit these paddles into a section of the mast, as shown in FIG. 4, and use the dual paddle thus formed in the fashion of a kayak dual paddle.

Figure 3:
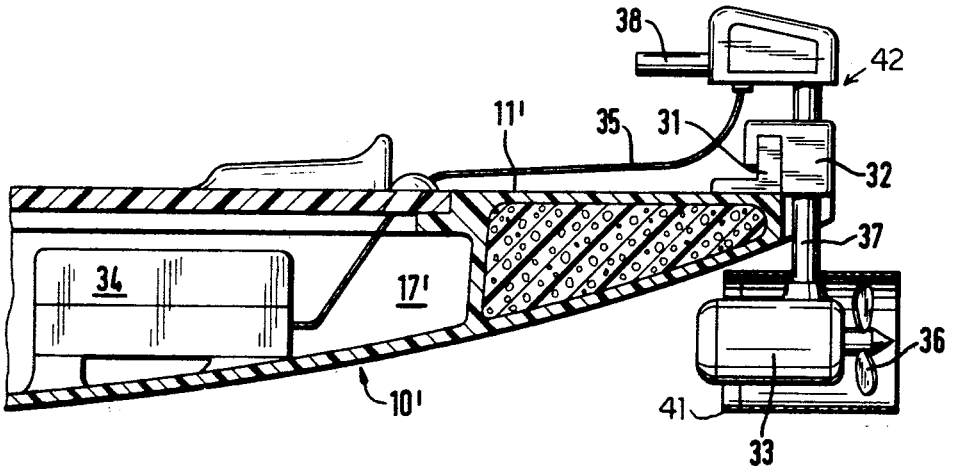
FIG. 3 is a large-scale sectional view of a detail of another arrangement according to this invention.

It is also possible as shown in FIG. 3 to have a storage compartment 17′ underneath the upper surface 11′ of a board 10′ which contains a permanently mounted storage battery 34. A cable 35 connects this battery 34 to the electric motor 33 mounted on the bottom of the shaft 37 of an electric outboard motor 42 having a control arm 38. The brackets 32 on which the motor 33 and handle 38 swivels is secured to a mount 31 at the rear end of the body 10′. A propeller or screw 36 is mounted on the motor 33 and the entire structure is surrounded by a cylindrical shroud 41 to prevent a user from being injured by this screw 36. The outboard motor 42 constituted by the structure 32, 33 and 36–38 is small enough to fit inside the compartment 17′ adjacent the battery 34. Clips are provided inside this compartment 17′ to hold the outboard motor 42 snugly in place. Such an arrangement is extremely advantageous when it is necessary to travel a considerable distance from the shore or along the shore with the windsurfer.

Although the modifications described above are particularly directed at a windsurfer, it is possible to provide the improvements according to this invention on other sporting equipment such as a standard surfboard, a light sail boat, or the like.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A windsurfer comprising:

an elongated floatable surfer body having an upper surface and formed with an openable storage compartment which is configurated as a recess in said body;

a daggerboard mountable on said body in a position projecting downwardly therefrom;

a removable lid formed as a flat plate having one side provided with a raised seat and another generally flat side, said lid fitting over said compartment in a windsurfing position with said seat engaged in said compartment and said flat side up, and in a riding position with said seat up so as to support a user in a sitting position and said flat side turned toward said compartment;

a mast securable to said upper surface of said body;

a boom secured to said mast; and means engageable in water supporting said body for propelling said body in the water and storable in said compartment, said means for propelling including two paddles receivable in said compartment and each having a respective handle, said mast being formed at its ends with recesses each adapted to snugly receive a respective paddle handle in such a position that said mast with said paddles in said recess is a double-blade kayak-type paddle.

2. A windsurfer comprising:

an elongated floatable surfer body having an upper surface and an openable storage compartment which is constituted as a recess in said body;

a mast securable to said upper surface;

a boom secured to said mast;

means engageable in water supporting said body for propelling said body in the water, said means being storable in said compartment;

a daggerboard mountable on said body in a position projecting downwardly therefrom; and a removable lid arranged to close said recess and formed as a substantially flat plate having two side surfaces, one of said side surfaces of said plate being substantially flat whereas the other side surface is provided with a raised formation forming a seat which is raised above said other side surface, said plate being fitted over said recess in a windsurfing position in which said other side surface faces toward and said raised seat extends into said recess whereas said one flat surface faces upwardly so that it presents no hindrance to windsurfing, and in a riding position in which said flat one side surface faces toward said recess whereas said other surface and said raised seat face upwardly so that a user can sit on said raised seat.

3. The windsurfer defined in claim 2, wherein said body is formed at said upper surface in front of said seat with a pair of recesses dimensioned to receive the heels of a person sitting in said seat.

4. The windsurfer defined in claim 2, wherein said body is formed at said upper surface at each end of said body with a holder adapted to secure said mast to said body in a position lying on said upper surface thereof and extending generally parallel to said body.

5. The windsurfer defined in claim 2, wherein said means for propelling is an outboard motor receivable in said compartment under said lid.

6. The windsurfer defined in claim 2, wherein said means for propelling is a paddle receivable in said compartment under said lid.

7. The windsurfer defined in claim 2, wherein said body is provided with clips for holding said mast on said upper surface.

8. The windsurfer defined in claim 7, wherein said clips are on said upper surface adjacent the ends of said body and said seat is formed with a groove alignable between said clips for receiving said mast underneath a person sitting on said seat.

9. A windsurfer as defined in claim 2, wherein said seat has a bottom portion which is raised above said other side surface of said plate, and a back portion is also raised above said other side surface and extends upwardly of said bottom portion, said portions of said seat being of one piece with one another and both extending into said recess when said plate is in said windsurfing position.

10. A windsurfer as defined in claim 2, wherein said flat one surface of said lid forms a part of said upper surface of said body in said windsurfing position.

* * * * *